US008282232B2

(12) United States Patent
Hsu et al.

(10) Patent No.: US 8,282,232 B2
(45) Date of Patent: Oct. 9, 2012

(54) ILLUMINATING TEXTILE ARTICLE

(75) Inventors: Fu-Biau Hsu, Taipei (TW); Chun-Jung Kuo, Taipei (TW)

(73) Assignee: Fu-biau Hsu, Taipei (TW)

( * ) Notice: Subject to any disclaimer, the term of this patent is extended or adjusted under 35 U.S.C. 154(b) by 267 days.

(21) Appl. No.: 12/578,507

(22) Filed: Oct. 13, 2009

(65) Prior Publication Data

US 2010/0259925 A1 Oct. 14, 2010

(30) Foreign Application Priority Data

Apr. 8, 2009 (TW) ..... 98205624 U

(51) Int. Cl.
*D03D 15/00* (2006.01)

(52) U.S. Cl. ..... 362/103; 362/231; 362/249.02; 442/229; 442/301

(58) Field of Classification Search ..... 362/103, 362/231, 249.02, 249.06, 800; 174/254; 139/425 R; 442/229, 301, 316, 377; 428/370, 428/371, 364, 373, 375, 377
See application file for complete search history.

(56) References Cited

U.S. PATENT DOCUMENTS

| | | | | |
|---|---|---|---|---|
| 6,210,771 | B1 * | 4/2001 | Post et al. | 428/100 |
| 6,727,197 | B1 * | 4/2004 | Wilson et al. | 442/301 |
| 7,144,830 | B2 * | 12/2006 | Hill et al. | 442/205 |
| 7,348,285 | B2 * | 3/2008 | Dhawan et al. | 442/229 |
| 7,592,276 | B2 * | 9/2009 | Hill et al. | 442/301 |

FOREIGN PATENT DOCUMENTS

WO WO 2008/044202 * 4/2008

* cited by examiner

*Primary Examiner* — Peggy A. Neils

(57) ABSTRACT

The invention discloses an illuminating textile article including a diode-based lighting device and a textile body. The diode-based lighting device has M contact points where M is an integer equal to or larger than 2. The textile body is constituted by N conductive yarns and at least one non-conductive yarn where N is an integer equal to or larger than 2, and provides M' conductive exposed portions of the conductive yarns which are separated by the at least one non-conductive yarn from one another. Each of the M contact points corresponds to one of the M' conductive exposed portions and is fixed to the corresponding conductive exposed portion. The conductive yarns provide terminals for electric connection of a power supply.

14 Claims, 8 Drawing Sheets

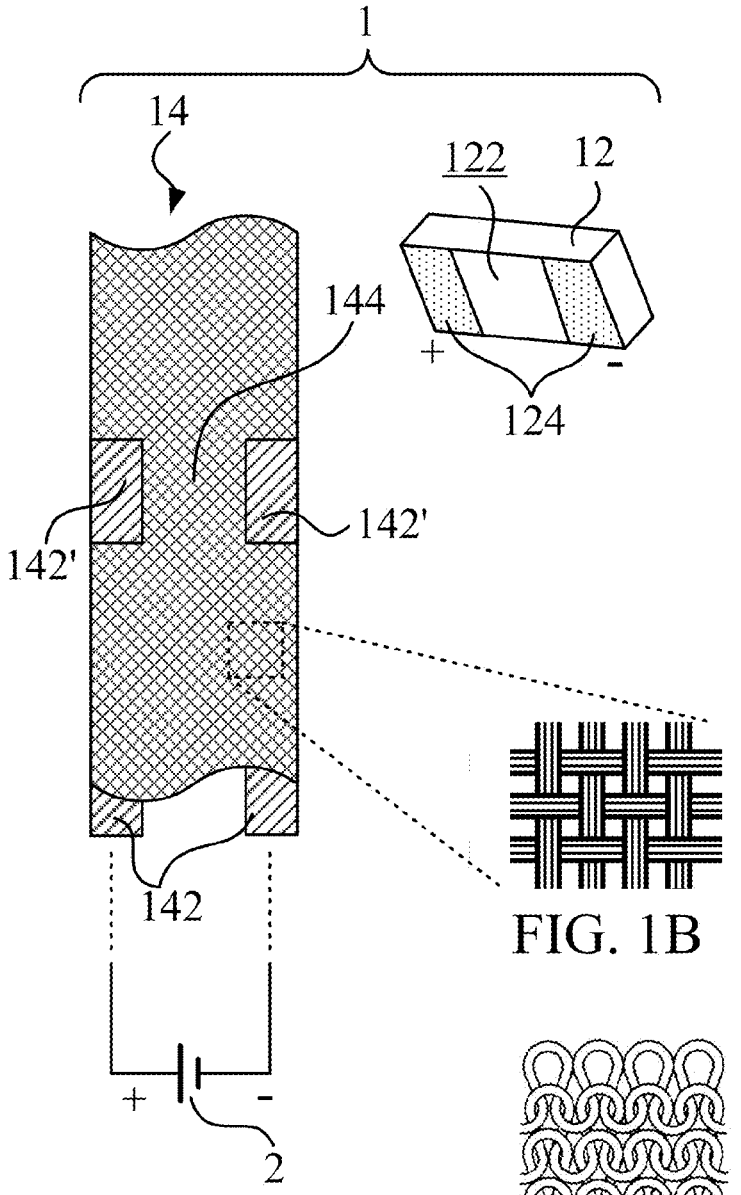
FIG. 1A
FIG. 1B
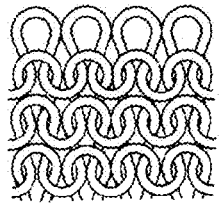
FIG. 1C
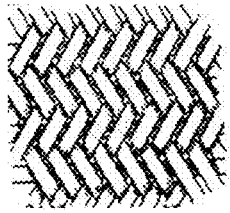
FIG. 1D

ILLUMINATING TEXTILE ARTICLE

BACKGROUND OF THE INVENTION

1. Field of the Invention

This present invention relates to an illuminating textile article. Moreover, in particular, the illuminating textile article according to the invention is a textile article incorporating with LEDs (light-emitting diode), can be served as a product as requirement, and can be served as a textile yarn for another textile article.

2. Description of the Prior Art

Nowadays, light-emitting diodes have been used for a wide variety of applications, e.g., indication, display, illumination, etc. Combination of apparatuses and light-emitting diodes has been formerly practiced on electronic equipments with indicators, traffic lights, lighting fixtures, street lamps, and gradually emerged in textile such as clothing.

One of current approaches regarding textile articles incorporating with light-emitting diodes is first to bond light-emitting diodes on a flexible printed circuit board, and then to attach the flexible printed circuit board with fixed light-emitting diodes to a textile article. Obviously, the flexible printed circuit board utilized in the aforesaid approach can not be excessively bent or stretched due to its limited flexibility. Therefore, in order to retain somewhat flexibility for such textile articles, aforesaid approach mostly utilizes flexible printed circuit boards with smaller area. Nevertheless, the textile articles of the aforesaid approach can not get aesthetically pleasing design and wearing comfort like general textile articles, and therefore, they are difficult for consumers to accept. Besides, if using flexible printed circuit boards with larger area, the aforesaid approach would result in that weight and thickness of finished textile articles are increased and the flexible printed circuit boards with fixed light-emitting diodes are more difficult to be integrated with general textile articles into aesthetically pleasing designs. Furthermore, if changing layout of light-emitting diodes, the aforesaid approach must consume much time and cost to design the flexible printed circuit board renewedly. Furthermore, the manufacture of flexible printed circuit board used in the aforesaid approach is heavy pollution process and harm to environment.

Another prior art is to fix optical fibers or flexible light-conducting tubes, whose surfaces are capable of leaking entered light out, on general textile articles in an attaching way or a textile way. Light emitted by light-emitting diodes enters into those optical fibers or flexible light-conducting from one end of those optical fibers or flexible light-conducting tubes, and is leaked out from the surfaces of those optical fibers or flexible light-conducting tubes. Due to poor wearing comfort and softness of those optical fibers or flexible light-conducting tubes and difficulty of connecting light sources with textile articles, the prior art has much limitation in practice and process. Besides, the prior art can not approach requirements of textile articles with larger area and individual control over lighting points, and has lower illumination.

SUMMARY OF THE INVENTION

Accordingly, one aspect of the invention is to provide an illuminating textile article which is made in a textile technology and incorporates with light-emitting diodes. Particularly, the illuminating textile article according to the invention has excellent flexibility, light weight, wearing comfort like general textile articles, rapid manufacture, low cost, ability to achieve larger area, convenience of changing layout of light-emitting diodes, aesthetically pleasing overall design, no pollution, easy control of change of light source, etc. advantages and efficiencies to make textile articles perfectly incorporating with light-emitting diodes that prior arts cannot be achieved.

According to a preferred embodiment, the illuminating textile article includes a diode-based lighting device and a textile body. The diode-based lighting device has M contact points where M is an integer equal to or larger than 2. The textile body is constituted by N conductive yarns and at least one non-conductive yarn where N is an integer equal to or larger than 2. The textile body provides M' conductive exposed portions of the conductive yarns separated by the at least one non-conductive yarn from one another. Each of the M contact points corresponds to one of the M' conductive exposed portions and is fixed to the corresponding conductive exposed portion. The conductive yarns can provide terminals for electric connection of a power supply.

In one embodiment, the conductive yarn can be a coupling yarn constituted by at least one conductive core filament, a plurality of conductive short fibers, at least one non-conductive core filament or a plurality of non-conductive short fibers coupling with at least one metal wire. The conductive yarn can also be another coupling yarn constituted by at least one conductive core filament, a plurality of conductive short fibers, at least one non-conductive core filament or a plurality of non-conductive short fibers coupling with at least one rolled metal wire. The conductive yarn can also be a twisted yarn constituted by at least one metal wire twisting with at least one non-conductive yarn or another metal wire. The conductive yarn can also be a doubled yarn constituted by at least one metal wire or by at least one metal wire paralleling with another metal wires or at least one non-conductive yarn without any twist. The conductive yarn can be constituted by combination of aforesaid coupling yarms, twisted yarn and doubled yarn.

In one embodiment, materials used to fabricate aforesaid metal wires and rolled metal wires can be copper, CuNi alloys, CuNiSi alloys, CuNiZn alloys, CuNiSn alloys, CuCr alloys, CuAg alloys, CuW alloys, silver, gold, lead, zinc, aluminum, nickel, brass, phosphor bronze, beryllium copper, nichrome, tantalum, tungsten, platinum, palladium, stainless steels (e.g., 316, 304, 420, stainless steel containing Cu or Ag), titanium, titanium alloys (e.g., TA0, TA1, TA2, TA3, TA7, TA9, TA10, TC1, TC2, TC3, TC4(Ti6A14V)), Ni—Cr—Mo—W alloy, zirconium, zirconium alloys (e.g., alloy 702, alloy 704, alloy 705, alloy 706), HASTELLOY alloys (e.g., alloy C-22, alloy B-2, alloy C-22), Nickel alloys (e.g., Nickel 200, Nickel 201), MONEL alloys (e.g., alloy 400, alloy R-405, alloy K-500), ICONEL alloys (e.g., alloy 600, alloy 625), FERRALIUM alloy (alloy 255), NITRONIC alloys (e.g., NITRONIC 60, NITRONIC 50, NITRONIC 30), CARPENTER alloy (alloy 20Cb-3), or other commercial metal or alloy.

In one embodiment, the diode-based lighting device may include a white LED device (for example, blue LED packaged with YAG phosphor), a multi-color LED device, a blue LED device, a green LED device, a yellow LED device, a red LED device, or a laser diode.

In one embodiment, the textile body can be made in a knitting way, a warp knitting way, a weft knitting way, a weaving way, or a braiding way.

In one embodiment, the diode-based lighting devices can be fixed on the exposed portions by a soldering process, a welding process, a conductive agent bonding process, or a sewing process.

In one embodiment, the textile body is treated to exhibit a pattern in a jacquard way, an embroidering way, a printing way, or a dyeing way.

The aspect of the present invention will no doubt become obvious to those of ordinary skill in the art after reading the following detailed description of the preferred embodiment, which is illustrated in the following figures and drawings.

BRIEF DESCRIPTION OF THE APPENDED DRAWINGS

FIG. 1A illustratively shows an illuminating textile article 1 according to a preferred embodiment of the invention, and also shows a diode-based lighting device 12 and a textile body 14 that are two essentials of the illuminating textile article 1.

Figure 1E:
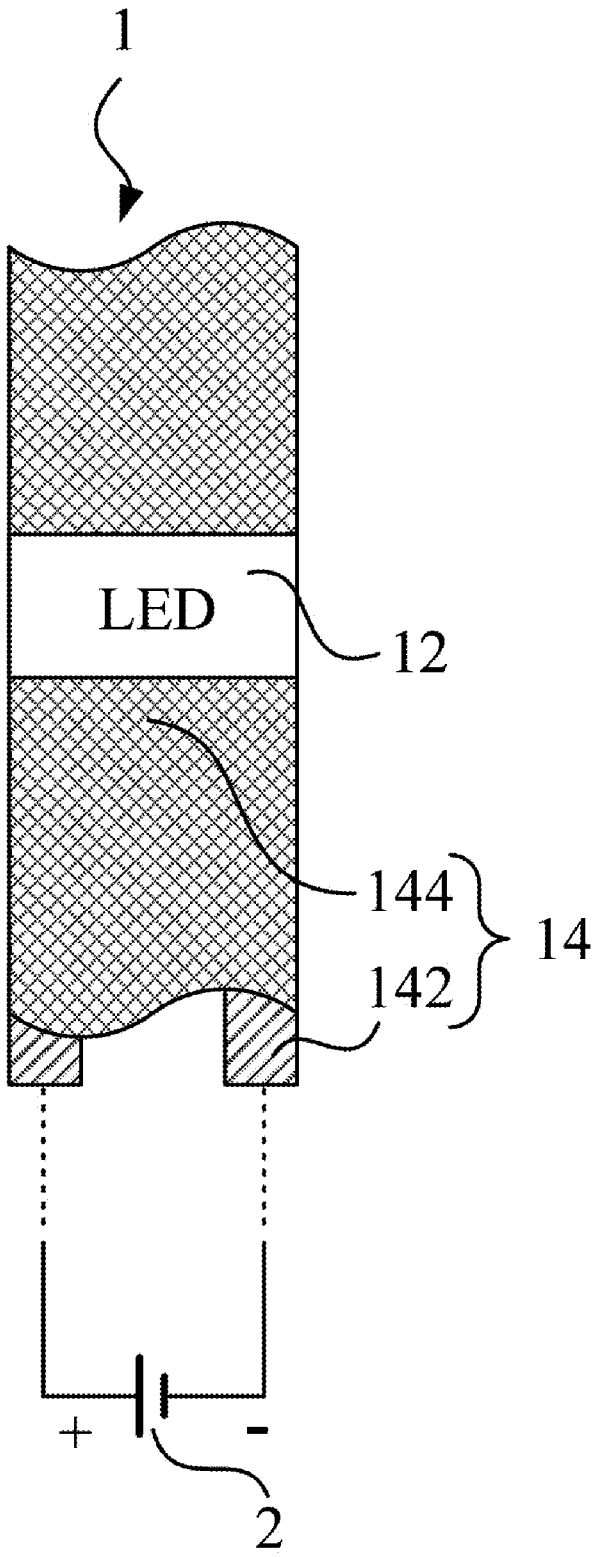
FIG. 1B is a sectional magnified diagram of the textile body 14 shown in FIG. 1A to show that the textile body 14 is made in a weaving way.
FIG. 1C is a sectional magnified diagram of the textile body 14 shown in FIG. 1A to show that the textile body 14 is made in a knitting way.
FIG. 1D is a sectional magnified diagram of the textile body 14 shown in FIG. 1A to show that the textile body 14 is made in a braiding way.

FIG. 1E illustratively shows a finished illuminating textile article 1 where the diode-based lighting device 12 is fixed onto the textile body 12 shown in FIG. 1A.

Figure 2:
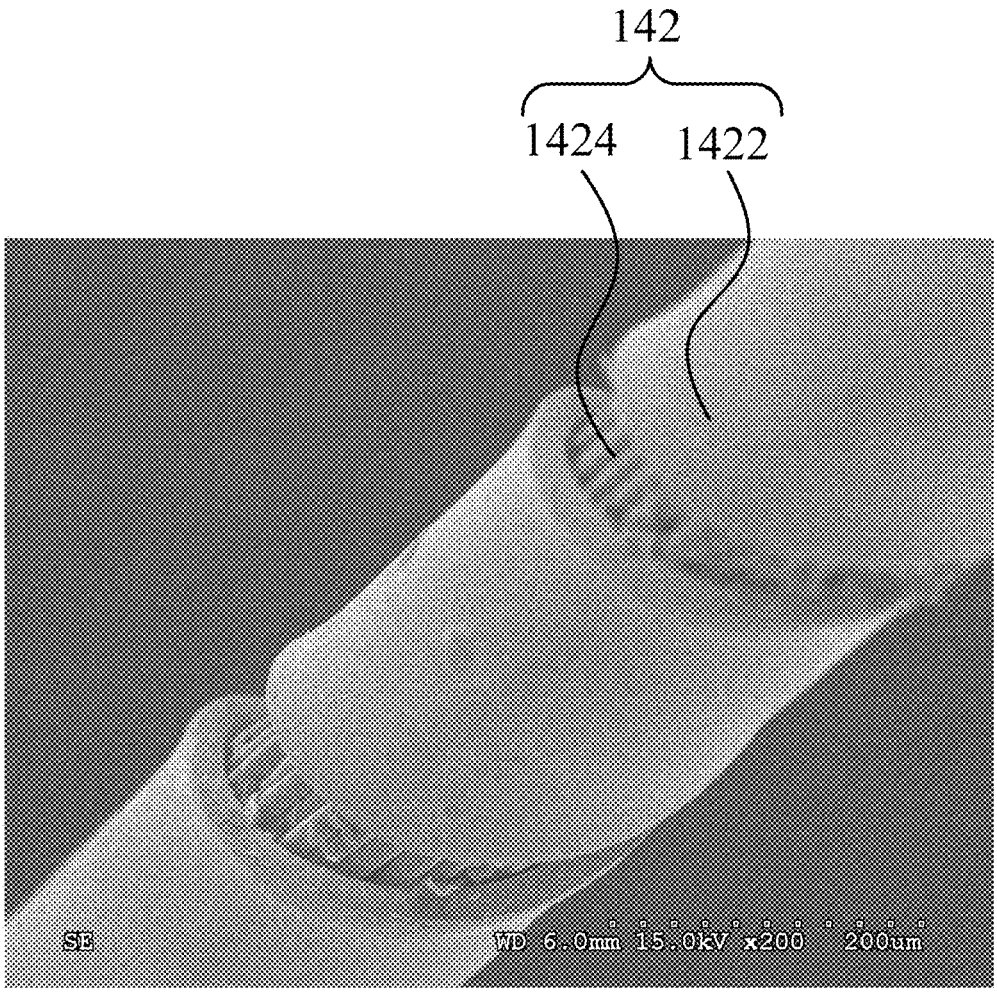

FIG. 2 is an SEM photograph of a coupling yarn 142 constituted by a plurality of polyester core filaments 1424 tightly coupling with a rolled copper wire 1422.

Figure 3A:
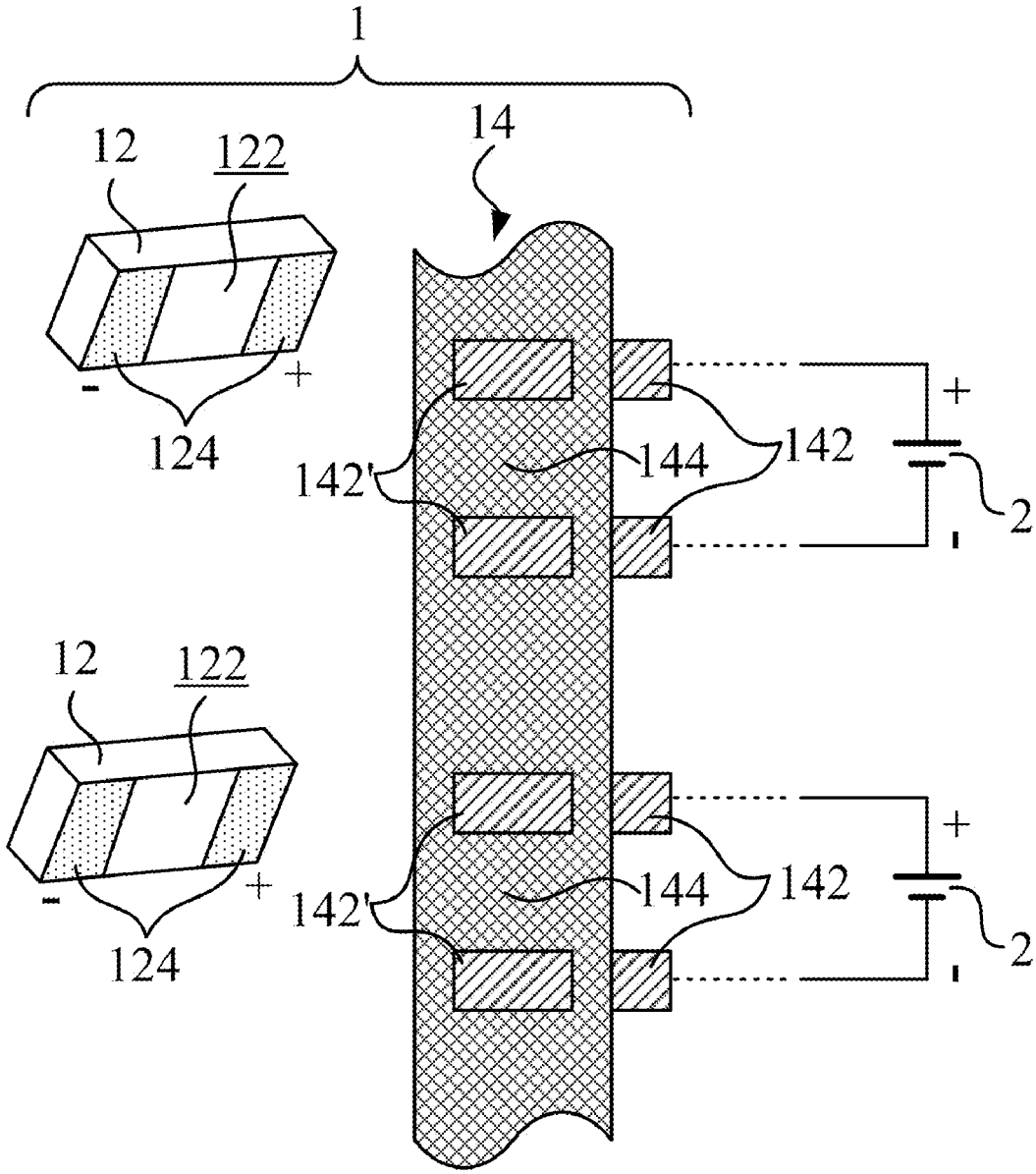

FIG. 3A illustratively shows an illuminating textile article 1 according to another preferred embodiment of the invention, and also shows two diode-based lighting devices 12 and a textile body 14 that are essentials of the illuminating textile article 1.

Figure 3B:
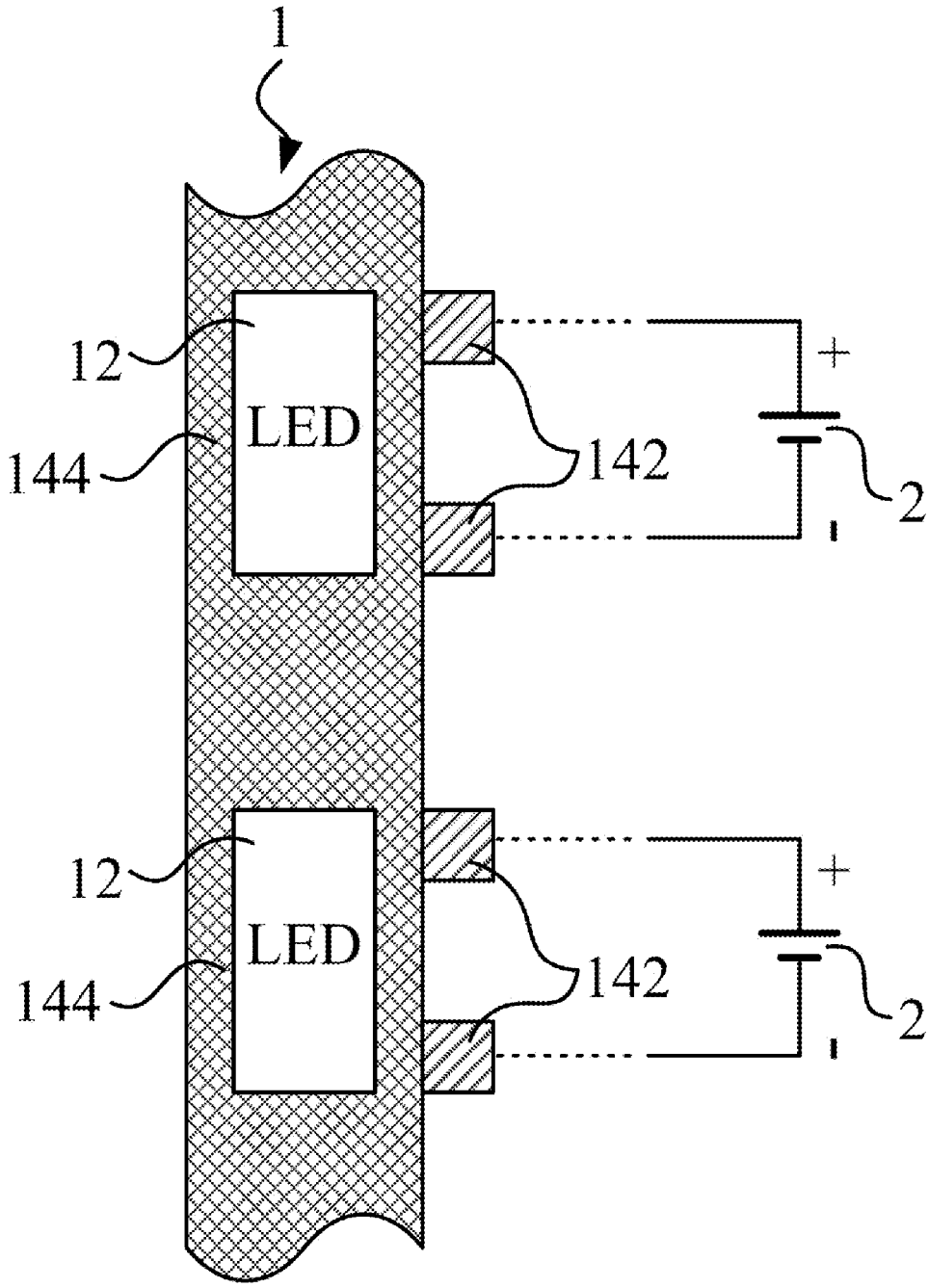

FIG. 3B illustratively shows a finished illuminating textile article 1 shown in FIG. 3A where two diode-based lighting devices 12 are fixed onto the textile body 12.

Figure 4A:
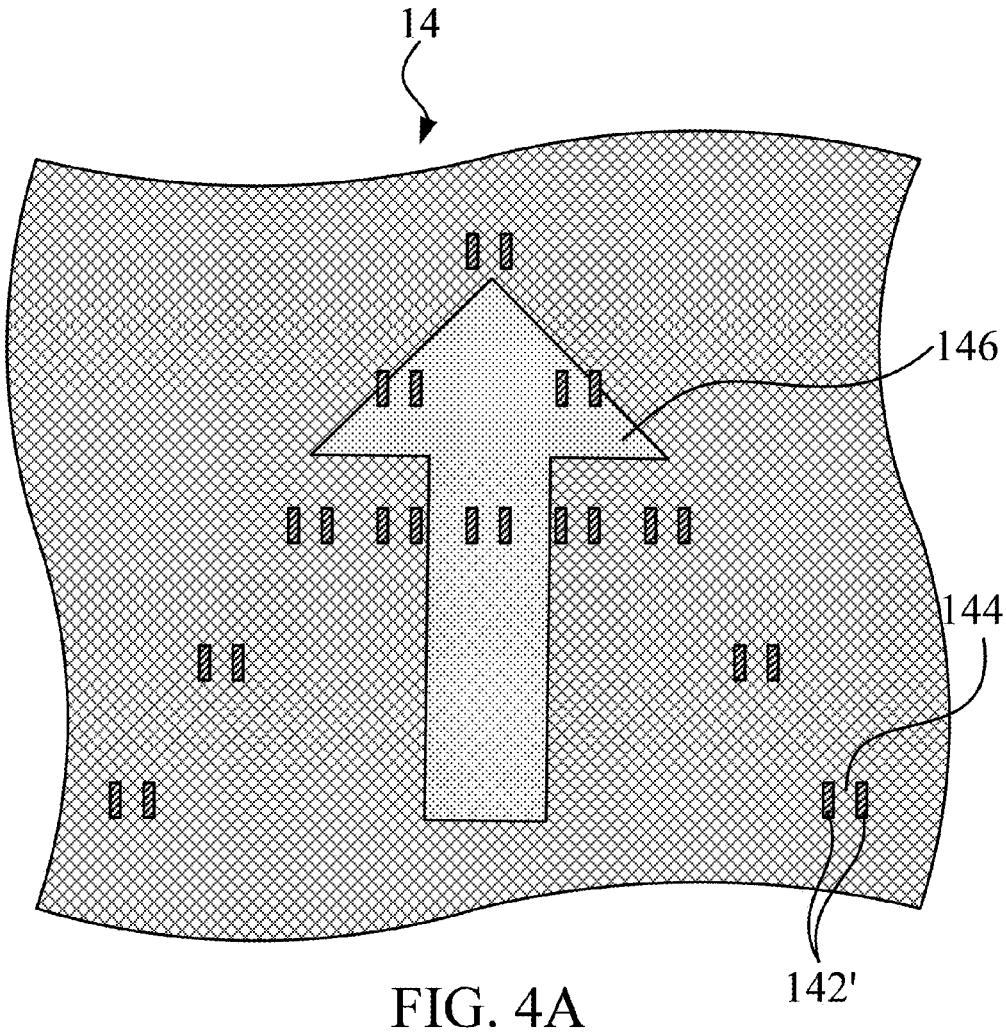

FIG. 4A illustratively shows a partial outside perspective view of the textile body 14 of the illuminating textile article 1 according to the invention where the textile body 14 thereon has grouped conductive exposed portions 142' arranged to exhibit an A-shape pattern.

Figure 4B:
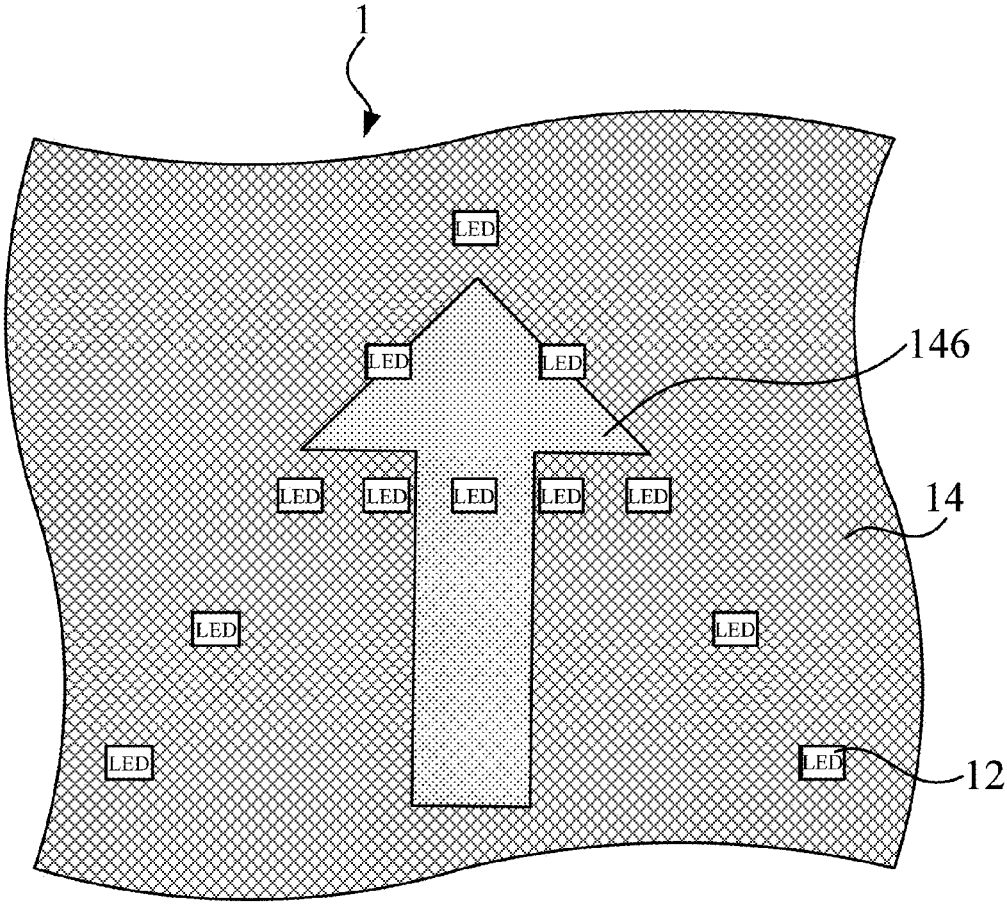

FIG. 4B illustratively shows an outside perspective view of a finished illuminating textile article 1 shown in FIG. 4A where the diode-based lighting devices 12 are fixed onto the textile body 12.

Figure 5:
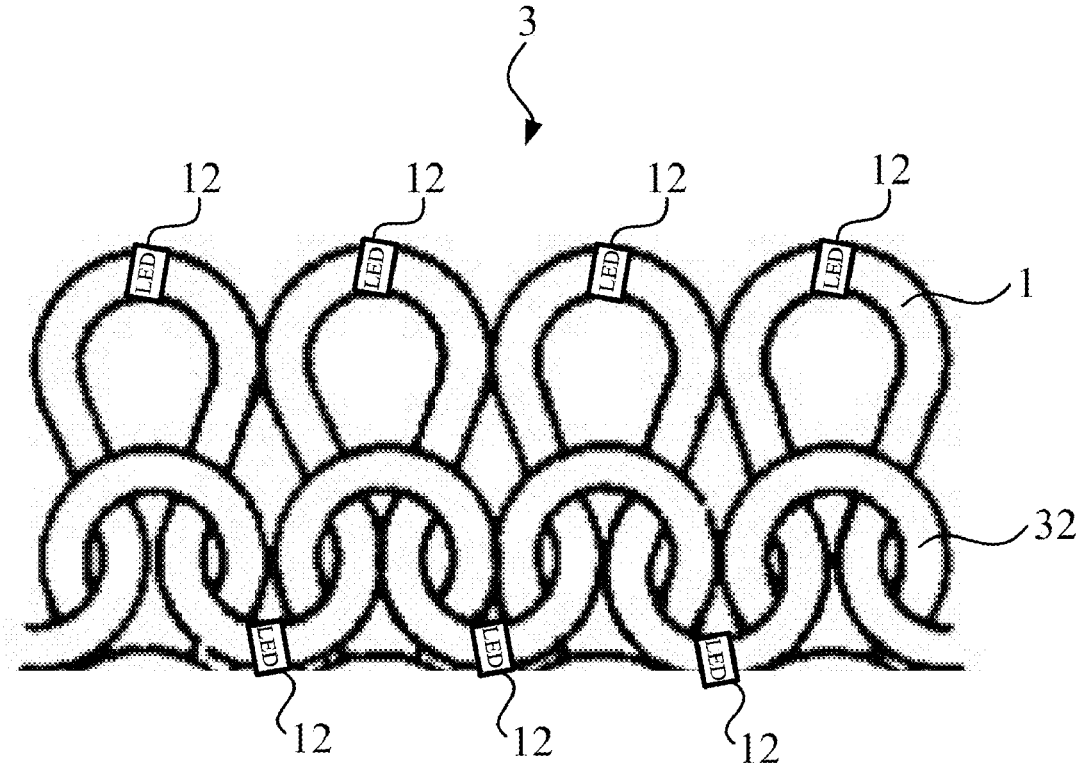

FIG. 5 schematically shows a partial perspective view of a textile structure 3 constituted by the ribbon-like illuminating textile article 1 and another textile yarn 32 connecting with the ribbon-like illuminating textile article 1 in a knitting way.

DETAILED DESCRIPTION OF THE INVENTION

Some preferred embodiments and practical applications of this present invention would be explained in the following paragraph, describing the characteristics, spirit and advantages of the invention.

Referring to FIGS. 1A to 1E, those figures disclose an illuminating textile article 1 according to a preferred embodiment of the invention and possible main textile structures thereof.

As shown in FIG. 1A, the illuminating textile article 1 according to the preferred embodiment of the invention includes a diode-based lighting device 12 and a textile body 14. The diode-based lighting device 12 has M contact points 124 where M is an integer equal to or larger than 2. For explanation purpose only, FIG. 1A shows the diode-based lighting device 12 having two contact points 124 formed on a lower surface 122 thereof. In practical application, the diode-based lighting device 12 is, preferable but not limited to, a surface-mounted type of diode-based lighting device.

Also shown in FIG. 1A, the textile body 14 is constituted by N conductive yarns 142 and at least one non-conductive yarn 144 where N is an integer equal to or larger than 2. Using textile technologies, the conductive yarns 142 create M' conductive exposed portions 142' in the textile body 14. Similarly, for explanation only, FIG. 1A illustrates two conductive exposed portions 142'.

In one embodiment, the conductive yarn 142 can be a coupling yarn constituted by at least one conductive core filament, a plurality of conductive short fibers, at least one non-conductive core filament or a plurality of non-conductive short fibers coupling with at least one metal wire. The conductive yarn 142 can also be another coupling yarn constituted by at least one conductive core filament, a plurality of conductive short fibers, at least one non-conductive core filament or a plurality of non-conductive short fibers coupling with at least one rolled metal wire. The conductive yarn 142 can also be a twisted yarn constituted by at least one metal wire twisting with at least one non-conductive yarn or another metal wire. The conductive yarn 142 can also be a doubled yarn constituted by at least one metal wire or by at least one metal wire paralleling with another metal wire or at least one non-conductive yarn without any twist. The conductive yarn 142 can be constituted by combination of aforesaid coupling yarns, twisted yarn and doubled yarn. The constituents of aforesaid conductive yarns can be suitably selected to meet requirement of specific functions, e.g., tensile strength, flexibility, fire resistance, conductivity, etc. FIG. 2 is an SEM photograph of a conductive yarn 142 constituted by a plurality of polyester core filaments 1424 tightly coupling with a rolled copper wire 1422. It is proved that the coupling yarn 142 shown in FIG. 2 has excellent flexibility.

In one embodiment, materials used to fabricate aforesaid metal wires and rolled metal wires can be copper, CuNi alloys, CuNiSi alloys, CuNiZn alloys, CuNiSn alloys, CuCr alloys, CuAg alloys, CuW alloys, silver, gold, lead, zinc, aluminum, nickel, brass, phosphor bronze, beryllium copper, nichrome, tantalum, tungsten, platinum, palladium, stainless steels (e.g., 316, 304, 420, stainless steel containing Cu or Ag), titanium, titanium alloys (e.g., TA0, TA1, TA2, TA3, TA7, TA9, TA10, TC1, TC2, TC3, TC4(Ti6A14V)), Ni—Cr—Mo—W alloy, zirconium, zirconium alloys (e.g., alloy 702, alloy 704, alloy 705, alloy 706), HASTELLOY alloys (e.g., alloy C-22, alloy B-2, alloy C-22), Nickel alloys (e.g., Nickel 200, Nickel 201), MONEL alloys (e.g., alloy 400, alloy R-405, alloy K-500), ICONEL alloys (e.g., alloy 600, alloy 625), FERRALIUM alloy (alloy 255), NITRONIC alloys (e.g., NITRONIC 60, NITRONIC 50, NITRONIC 30), CARPENTER alloy (alloy 20Cb-3), or other commercial metal or alloy.

In one embodiment, materials used to fabricate the non-conductive yarns 144 can be polyester, polyamide, polyacrylic, polyethylene, polypropylene, cellulose, protein, elastomeric, polytetrafluoroethylene, poly-p-phenylenebenzobisoxazole (PBO), polyetherketone, carbon, glass fiber, or materials of other commercial non-conductive textile yarns.

In one embodiment, the textile body 14 can be made in a knitting way, a warp knitting way, a weft knitting way, a weaving way, or a braiding way. FIG. 1B schematically shows the textile structure of the textile body 14 made in a weaving way. FIG. 1C schematically shows the textile structure of the textile body 14 made in a knitting way. FIG. 1D schematically shows the textile structure of the textile body 14 made in a braiding way.

It needs to be stressed that the M conductive exposed portions 142' are separated by the at least one non-conductive yarn 144 from one another, and that each of the M contact points 124 corresponds to one of the M' conductive exposed portions 142'. For example, two contact points 124 of the diode-based lighting device 12 shown in FIG. 1A respectively serve as positive electrode and negative electrode, and similarly, the corresponding conductive exposed portions 142' on the textile body 14 serve as a positive electrode and a negative electrode respectively.

The diode-based lighting device 12 is fixed with two contact points 124 thereof to corresponding conductive exposed portions 142' to finish the illuminating textile article 1, as shown in FIG. 1E. The conductive yarns 142 also provide terminals for electric connection of a power supply 2. It needs to be stressed that FIGS. 1A and 1E only illustrate a diode-based lighting device 12 electrically connected in parallel with the power supply 2. Therefore, the textile body 14 shown FIGS. 1A and 1E includes two conductive yarns 142. In practical application, the textile body 1 according to the invention thereon may have a plurality of diode-based lighting devices 12 fixed, and the fixed diode-based devices 12 may be all connected in series, all connected in parallel, or connected in series-parallel with the power supply. For different layouts meeting different electrical connections and control requirements of the diode-based lighting devices 12, the illuminating textile article 1 according to the invention can utilize textile technology to achieve these layouts easily, and in particular, the manufacture of the illuminating textile article 1 is rapid, low cost, and pollution-free.

Referring to FIGS. 3A and 3B, those figures disclose an illuminating textile article 1 according to another preferred embodiment of the invention. FIG. 3A discloses the illuminating textile article 1 including two diode-based lighting devices 12 and a textile body 14. Using textile technology, it results in that the textile body 14 in FIG. 3A provides two sets of conductive exposed portions 142'. Such two diode-based lighting devices 12 are fixed with respective two contact points 124 thereof to the corresponding conductive exposed portions 142' to finish the illuminating textile article 1, as shown in FIG. 3B. In particular, the conductive yarns 142 also provide each diode-based lighting device 12 with terminals for electric connection of a respective power supply 2. As designed shown in FIG. 3B, such two diode-based lighting devices 12 can be controlled individually.

In one embodiment, the contact points 124 of the diode-based lighting device 12 can be fixed to the corresponding conductive exposed portions 142' by a soldering process, a welding process (e.g., ultrasonic welding process), a sewing process, and a conductive agent bonding process. It needs to be stressed that if the contact points of the diode-based lighting device 12 are fixed to the corresponding conductive exposed portions 142' by a sewing process, the diode-based lighting device 12 have exposed pins serving as the contact points 124 and essentially having through holes or jags which conductive sewing threads such as aforesaid conductive yarns or other metal or alloy wires can pass through.

In one embodiment, the diode-based lighting device 12 may include a white LED device (for example, blue LED packaged with YAG phosphor), a multi-color LED device, a blue LED device, a green LED device, a yellow LED device, a red LED device, or a laser diode. It needs to be stressed that the mentioned-above diode-based lighting device 12 may contain more than two contact points 124; therefore, it is necessary that the equivalent number of corresponding conductive contact exposed portions 142' are provided on the textile body 14 of the illuminating textile article 1 according to the invention. The size of the diode-based lighting device 12 could be chosen according to the practical requirements from current commercial-sizes chips, e.g., 0603-sized (6 mm×3 mm) chips, 0805-sized (8 mm×5 mm) chip, 1206-sized (12 mm×6 mm) chips, 1210-sized (12 mm×10 mm) chips, etc.

In practical application, the arrangement of the diode-based lighting devices 12 may also depend on the requirement of design pattern on the textile body 14. That is, positions of each set of conductive exposed portions 142' (the number of one set of conductive floating points equals to 2 or more) can be arranged by a textile way, e.g., a knitting way, a warp knitting way, a weft knitting way, a weaving way, a braiding way, a jacquard way, an embroidering way etc. on the textile body 14. Then, the diode-based lighting devices 12 are fixed on the textile body 14 corresponding to said design pattern.

Referring to FIGS. 4A and 4B, those schematically show a partial outside perspective view of the textile body 14, the diode-based lighting devices 12 and the finished product of one illuminating textile article 1, according to the invention, with larger area particularly. As shown in FIG. 4A, on the textile body 14, the grouped conductive exposed portions 142' are arranged to exhibit a pattern of character "A". Especially, the textile body 14 shown in FIG. 4A is also treated to exhibit another pattern 146 to achieve an aesthetically pleasing overall design or different visual effects in a jacquard way, an embroidering way, a printing way, a dyeing way, or other conventional textile treating ways. This example in FIG. 4A shows an arrow pattern 146. As shown in FIG. 4B, each set of the diode-based lighting devices 12 is fixed to the corresponded set of conductive exposed portions 142' to finish the illuminating textile article 1 having "A"-character-patterned arrangement of diode-based lighting devices 12 and arrow pattern 146. The illuminating textile article 1 shown in FIG. 4B thereon shows conspicuous arrow pattern 146 when ambient illumination is enough and the diode-based lighting devices 12 are turned off; otherwise, the diode-based lighting devices 12 arranged in "A" character pattern has better visibility than the arrow pattern 146 when ambient illumination is weak and the diode-based lighting devices 12 are turned on. Obviously, in addition to aesthetically pleasing overall design, the illuminating textile article 1 according to the invention can achieve alterable visual effects.

In practical application, the illuminating textile article 1 according to the invention can be made into one-dimensional textile article such as a ribbon, two-dimensional textile article such as fabric, garment or net-like textile article, and three-dimensional textile article such as bag, cover, sheath or sleeve. In particular, the ribbon-like illuminating textile article 1 can be used directly (for example, used as a decoration replacing glow stick), can be used together with another article (for example, used together with safety vest to replace conventional reflective tape), and additionally, can serve as a textile yarn for another textile article. Referring to FIG. 5, FIG. 5 schematically shows a partial perspective view of a textile structure 3. As shown in FIG. 5, the textile structure 3 is constituted by the ribbon-like illuminating textile article 1 with fixed diode-based devices 12 and another textile yarn 32 connecting with the ribbon-like illuminating textile article 1 in a knitting way.

To sum up, compared with the prior arts of textile articles incorporating with light-emitting diodes, the illuminating textile article according to the invention has excellent flexibility, light weight, wearing comfort like general textile articles, rapid manufacture, low cost, ability to achieve larger area, convenience of changing layout of light-emitting diodes, aesthetically pleasing overall design, no pollution, easy control of change of light source, etc. advantages and efficiencies to make textile articles perfectly incorporating with light-emitting diodes that prior arts cannot achieve.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An illuminating textile article, comprising:

a diode-based lighting device having M contact points, M being an integer equal to or larger than 2; and a textile body constituted by N conductive yarns and at least one non-conductive yarn, N being an integer equal to or larger than 2, the textile body providing M' conductive exposed portions of the conductive yarns which are separated by the at least one non-conductive yarn from one another, each of the M contact points corresponding to one of the M conductive exposed portions and being fixed to the corresponding conductive exposed portion, wherein the conductive yarns provide terminals for electric connection of a power supply.

2. The illuminating textile article of claim 1, wherein the conductive yarns comprise one selected from the group consisting of a first coupling yarn, a second coupling yarn, a first twisted yarn, a doubled yarn, and a second twisted yarn, said first coupling yarn is constituted by at least one conductive core filament, a plurality of conductive short fibers, at least one non-conductive core filament or a plurality of non-conductive short fibers coupling with at least one metal wire, said second coupling yarn is constituted by at least one conductive core filament, a plurality of conductive short fibers, at least one non-conductive core filament or a plurality of non-conductive short fibers coupling with at least one rolled metal wire, said first twisted yarn is constituted by at least one metal wire twisting with at least one non-conductive yarn or another metal wire, said doubled yarn is constituted by at least one metal wire or by at least one metal wire paralleling with another metal wire or at least one non-conductive yarn without any twist, said second twisted yarn is constituted by combination of said first coupling yarn, said second coupling, said first twisted yarn and said doubled yarn.

3. The illuminating textile article of claim 2, wherein the metal wire constituting the first coupling yarn, the first twisted yarn or the doubled yarn and the rolled metal wire constituting the second coupling yarn are made of a material selected from the group consisting of copper, CuNi alloys, CuNiSi alloys, CuNiZn alloys, CuNiSn alloys, CuCr alloys, CuAg alloys, CuW alloys, silver, gold, lead, zinc, aluminum, nickel, brass, phosphor bronze, beryllium copper, nichrome, tantalum, tungsten, platinum, palladium, stainless steels, titanium, titanium alloys, Ni—Cr—Mo—W alloy, zirconium, zirconium alloys, HASTELLOY alloys, Nickel alloys, MONEL alloys, ICONEL alloys, FERRALIUM alloy, NITRONIC alloys, and CARPENTER alloy.

4. The illuminating textile article of claim 1, wherein the diode-based lighting device comprises one selected from the group consisting of a white LED device, a multi-color LED device, a blue LED device, a green LED device, a yellow LED device, a red LED device, and a laser diode.

5. The illuminating textile article of claim 1, wherein the textile body is made in one selected from the group consisting of a knitting way, a warp knitting way, a weft knitting way, a weaving way, and a braiding way.

6. The illuminating textile article of claim 1, wherein each contact point is fixed on the corresponding conductive exposed portion by one selected from the group consisting of a soldering process, a welding process, a conductive agent bonding process, and a sewing process.

7. The illuminating textile article of claim 1, wherein the textile body is treated to exhibit a pattern in one selected from the group consisting of a jacquard way, an embroidering way, a printing way, and a dyeing way.

8. An illuminating textile article, comprising:

N diode-based lighting devices which each has a set of M contact points, N being a natural number, M being an integer equal to or larger than 2; and a textile body constituted by a plurality of conductive yarns and at least one non-conductive yarn, the textile body providing N' sets of M' conductive exposed portions of the conductive yarns which are separated by the at least one non-conductive yarn from one another and arranged to exhibit a first pattern, each set of M contact points corresponding to one set of M' conductive exposed portions and being fixed to the corresponding conductive exposed portions, wherein the conductive yarns provide terminals for electric connection of a power supply.

9. The illuminating textile article of claim 8, wherein the conductive yarns comprise one selected from the group consisting of a first coupling yarn, a second coupling yarn, a first twisted yarn, a doubled yarn, and a second twisted yarn, said first coupling yarn is constituted by at least one conductive core filament, a plurality of conductive short fibers, at least one non-conductive core filament or a plurality of non-conductive short fibers coupling with at least one metal wire, said second coupling yarn is constituted by at least one conductive core filament, a plurality of conductive short fibers, at least one non-conductive core filament or a plurality of non-conductive short fibers coupling with at least one rolled metal wire, said first twisted yarn is constituted by at least one metal wire twisting with at least one non-conductive yarn or another metal wire, said doubled yarn is constituted by at least one metal wire or by at least one metal wire paralleling with another metal wire or at least one non-conductive yarn without any twist, said second twisted yarn is constituted by combination of said first coupling yarn, said second coupling, said first twisted yarn and said doubled yarn.

10. The illuminating textile article of claim 9, wherein the metal wire constituting the first coupling yarn, the first twisted yarn or the doubled yarn and the rolled metal wire constituting the second coupling yarn are made of a material selected from the group consisting of copper, CuNi alloys, CuNiSi alloys, CuNiZn alloys, CuNiSn alloys, CuCr alloys, CuAg alloys, CuW alloys, silver, gold, lead, zinc, aluminum, nickel, brass, phosphor bronze, beryllium copper, nichrome, tantalum, tungsten, platinum, palladium, stainless steels, titanium, titanium alloys, Ni—Cr—Mo—W alloy, zirconium, zirconium alloys, HASTELLOY alloys, Nickel alloys, MONEL alloys, ICONEL alloys, FERRALIUM alloy, NITRONIC alloys, and CARPENTER alloy.

11. The illuminating textile article of claim 8, wherein the diode-based lighting devices comprises one selected from the group consisting of a white LED device, a multi-color LED device, a blue LED device, a green LED device, a yellow LED device, a red LED device, and a laser diode.

12. The illuminating textile article of claim 8, wherein the textile body is made in one selected from the group consisting of a knitting way, a warp knitting way, a weft knitting way, a weaving way, and a braiding way.

13. The illuminating textile article of claim 8, wherein each set of contact points are fixed on the corresponding set of conductive exposed portions by one selected from the group consisting of a soldering process, a welding process, a conductive agent bonding process, and a sewing process.

14. The illuminating textile article of claim 8, wherein the textile body is treated to exhibit a second pattern in one selected from the group consisting of a jacquard way, an embroidering way, a printing way, and a dyeing way.

* * * * *